United States Patent [19]

Bixby

[11] 4,002,540

[45] Jan. 11, 1977

[54] SCREEN HAVING PARALLEL SLOTS

[75] Inventor: Leon C. Bixby, Owensboro, Ky.

[73] Assignee: Hendrick Manufacturing Company, Carbondale, Pa.

[22] Filed: June 16, 1975

[21] Appl. No.: 587,258

Related U.S. Application Data

[62] Division of Ser. No. 496,094, Aug. 9, 1974.

[52] U.S. Cl. ..... 204/24; 204/27

[51] Int. Cl.[2] ..... C25D 7/00; C25D 3/04

[58] Field of Search ..... 204/24, 27

[56] References Cited

UNITED STATES PATENTS

| | | | |
|---|---|---|---|
| 2,690,265 | 9/1954 | Bixby | 210/499 |
| 2,824,830 | 2/1958 | Hausner | 204/51 |
| 3,037,630 | 6/1962 | Bixby | 210/499 |
| 3,116,239 | 12/1963 | Bixby | 210/499 |
| 3,425,900 | 2/1969 | Purdy | 204/24 |
| 3,640,760 | 2/1972 | Nichols, Jr. | 210/499 |

FOREIGN PATENTS OR APPLICATIONS

| | | | |
|---|---|---|---|
| 331,196 | 10/1929 | United Kingdom | 204/24 |

*Primary Examiner*—T. M. Tufariello
*Attorney, Agent, or Firm*—Dybvig & Dybvig

[57] ABSTRACT

An industrial screen of the type having generally parallel wires looped about transverse support rods has chromium plated to at least the surfaces of the wire elements which contact one another in use. In the preferred embodiment hard chrome plating of entire wire elements is utilized.

4 Claims, 3 Drawing Figures

SCREEN HAVING PARALLEL SLOTS

This is a division of application Ser. No. 496,094 filed Aug. 9, 1974 for screen having parallel slots.

BACKGROUND OF THE INVENTION

1. Field of the Invention

This invention relates to industrial screens of the type utilized in the dewatering and sizing of ore materials, coals, and the like.

2. Description of the Prior Art

The prior art industrial screens heretofore used in the foregoing fields are basically of two types. In one type an effort is made to produce a screen which is generally rigid. The desire to seek rigidity results from experiences with industrial screens which are vibrated during their operation. Thus screens which have wires which can slide one adjacent another during vibration of the screen are found to wear excessively. Screen rigidity prevents this type of wear but introduces the disadvantages that the rigidity of the screen wires prevents movement or vibrations effective to dislodge particles which, being close to the opening size of the screen, tend to blind the screen.

Examples of generally rigid screens of the foregoing type appear in U.S. Pats. No. 2,697,620, 3,327,853, and 3,716,144.

In the second type of screen, called a two-part interflexing screen, an effort is made to so construct the screen as to allow inter-vibration of the elements which form the screen, thus to prevent blinding. Two primary modes of vibration occur. One is a vibration of individual wire elements transverse to their length, and the other is a flexation or vibration of the support rods, which also vibrate transverse to their length. If such vibration is permitted to occur, screen blinding is no problem because the motions of the screen parts relative to each other readily knock out particles that would otherwise blind the screen because close to the opening size between adjacent screen wires. As obvious from the previous discussion regarding rigid screens, there remained a problem due to the poor life exhibited by the interflexing type of screen when vibrated, especially at high vibration frequencies.

Since the interflexing screens had only approximately half the life of rigid screens, interflexing screens were not frequently used for high speed vibratory screen applications until a stagger weld principle of the type disclosed in U.S. Pat. No. 2,690,265 was developed. The stagger weld principle was a compromise between the desires for a rigid long lasting screen on the one hand and for an interflexing non-blinding screen on the other hand.

In the stagger weld screen, groups of adjacent wires were welded together so as to vibrate as a unit without deleterious friction. This concept was an obvious compromise, however, because the welded groups of wires still blinded and still rubbed frictionally, one group with respect to the other.

As described in the following summary of the invention a substantial improvement in the operating life of industrial screens particularly of the interflexing type has been achieved through the use of a properly applied chrome plating.

U.S. Pat. No. 3,425,900 illustrates chromium plating applied to a woven screen. However, the use of a plating such as chromium to prolong the life of industrial screens appears not to have been employed in the art prior to the present invention.

SUMMARY OF THE INVENTION

Two basic types of chromium plating are known in the art. In one type the objective is usually decoration and for this purpose a very thin flash of chrome is deposited upon a suitable primer such as copper to produce a bright and shiny chrome surface. In the second type, known as hard chrome, a much thicker deposit of chrome is applied directly onto a base metal such as steel without an intervening primer. Hard chrome deposits are frequently used in industrial applications which require high surface hardness. There exist two types of hard chrome deposits. In one type the hard chrome is relatively porous and this property is frequently desired for entrapping a thin layer of oil or other lubricant at the working surface of a part. In the other type, the hard chrome is a finely crystalline deposit characterized by good bond to metals such as steel and aluminum, a uniform plating thickness, good ductility, and a low porosity.

It has been noted that the finely crystalline hard chrome when rubbed against itself exhibits an exceptionally high lubricity and thus possesses an exceptionally good wear characteristic. Techniques for producing the finely crystalline hard chrome are disclosed in U.S. Pat. No. 2,824,830 and other patents issued to J. K. Hausner.

In the present invention finely crystalline hard chrome is applied to interflexing industrial screen wires, which may be steel or aluminum wires, paying particular heed to the need for an adequately thick deposit of chrome in those areas of the screen wires which are most subject to wear by reason of rubbing contact with adjacent wires.

An object of the present invention is to provide a new and improved industrial screen.

Another object of the present invention is to provide an interflexing industrial screen plated with finely crystalline hard chrome in portions thereof subject to wear.

Other objects and advantages reside in the construction of parts, the combination thereof, the method of manufacture and the mode of operation, as will become more apparent from the following description.

DESCRIPTION OF THE PREFERRED EMBODIMENT

Figure 1:
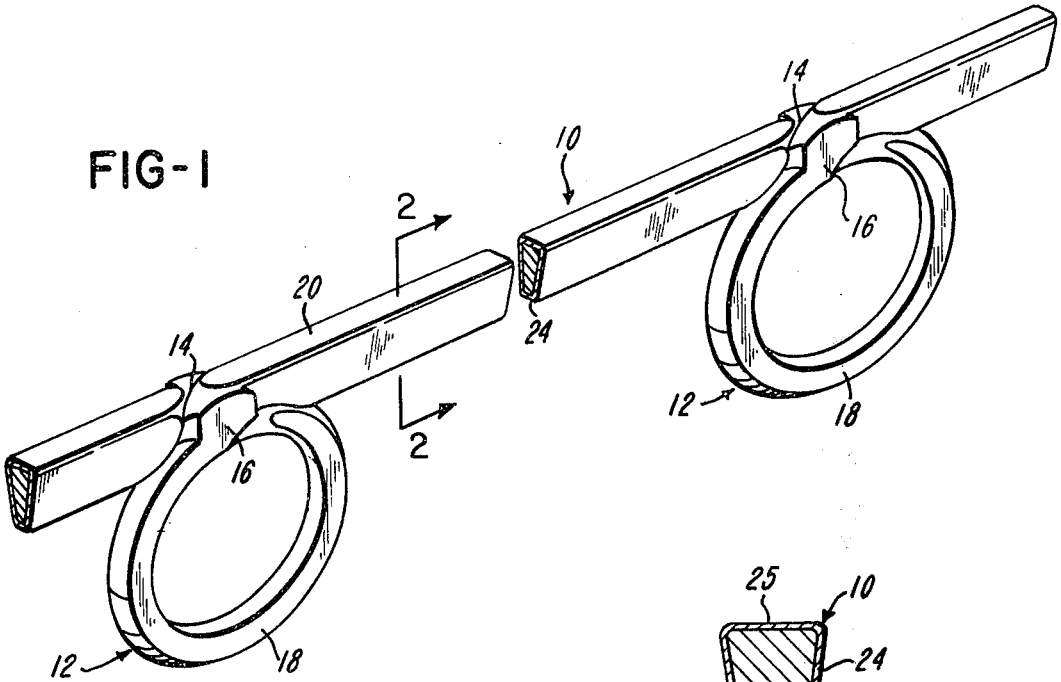
FIG. 1 is a perspective view with portions broken away of a screen wire in accordance with the present invention.

FIG. 1 illustrates a segment of wire that has been processed in a conventional looping and coining assembly. Prior to reaching the condition illustrated in FIG. 1, the wire was an indefinitely long unplated wire of circular cross-section stored and transported in the form of a spool. For the purpose of looping and coining, one end of the wire is fed into a looping stage and the entire spool of wire rotated 360° to cause the wire to form a loop about a loop forming pin. The loop forming pin is next indexed to advance the loop into a coining stage. There, the loop forming pin is replaced by a die pin which holds the first loop on center between coining dies while the loop forming pin returns to a position which allows a second loop to be formed about the forming pin by a second 360° rotation of the spool. Upon completion of the second loop, the loop forming pin is indexed once again to the coining dies. With such indexing, the first formed loop is advanced to a new position between the coining dies, both loops now residing and centered by die pins in spaced apart relation between the coining dies.

As before, the loop forming pin is then withdrawn from the coining dies and returned to the looping stage for formation of a third loop. As the third loop is being formed by a 360° rotation of the spool, the coining dies, which handle two loops simultaneously, are closed.

This process now continues indefinitely with successive 360° rotations of the spool during which the coining dies close. After each 360° rotation of the spool, a new loop is moved between the coining dies. Each loop formed by the looping machine is twice coined as the wire is indexed through the coining dies.

By means of the foregoing looping and coining process, a single strand of looped wire of any desired length can be produced. The center-to-center separation between loops is fixed by operation of the coining dies. The looped wire, as it progresses out of the coining dies, is cut after a pre-determined number of loops to form looped wire segments of a convenient length for industrial screens. The looped wire segments are then cleaned and placed in a plating bath for hard chrome plating.

A fragmentary piece of the resulting plated wire is identified by the reference number 10 in FIG. 1.

Figure 2:
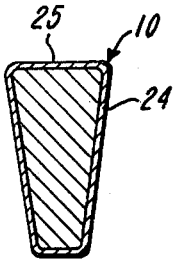
FIG. 2 is a section view taken substantially along the line 2—2 of FIG. 1.

The wire 10 can be seen to comprise successively formed loops 12 conncted by relatively straight sections 20. Except at the loop crossovers 14, the loops 12 have generally the original circular cross section of the wire, but are somewhat flattened, as shown by the surface 18, due to the pressure exerted by the coining dies which operated to reduce the thickness of the wire 10 at the loop crossovers 14. It will be noted that the coining dies also shaped the initially circular wire to a wedge shape or triangular shape, as illustrated in FIG. 2, along the lengths of the straight sections 20.

By way of illustration the initial circular wire may have a diameter of 0.123 inches. After coining the thickness of the crossovers 14 may be 0.142 inches. As the dies compress the crossovers 14 from an initial thickness of 0.246 inch (twice wire diameter) to a final thickness of 0.142 inches, the opposite sides of the crossovers 14 are flattened to form shoulders 16. The width of the upper surface 25 of the wedge shaped sections 20 may be 0.112 inch after coining.

The wires will form slots therebetween when assembled side by side. Assuming the above suggested dimensions, the width of each of the slots will be 0.030 inch, this being the difference between the thickness of the crossovers 14 and the width of the surfaces 25. However, these suggested screen dimensions are not maintained with accuracy unless a springback which occurs at the crossovers 14 upon separation of the coining dies has been corrected.

The looping and coining is performed before electroplating. In the embodiment illustrated the entire looped wire element has been plated with a deposit 24 of finely crystalline hard chrome. Ordinarily, for the purposes of the present invention, the chrome deposit or plating 24 is in the range of 3 to 5 thousandths of an inch. However, depending upon the severity of wear that the screen is expected to encounter, the thickness of the deposit 24 may range upwardly to 50 thousandths of an inch.

Figure 3:
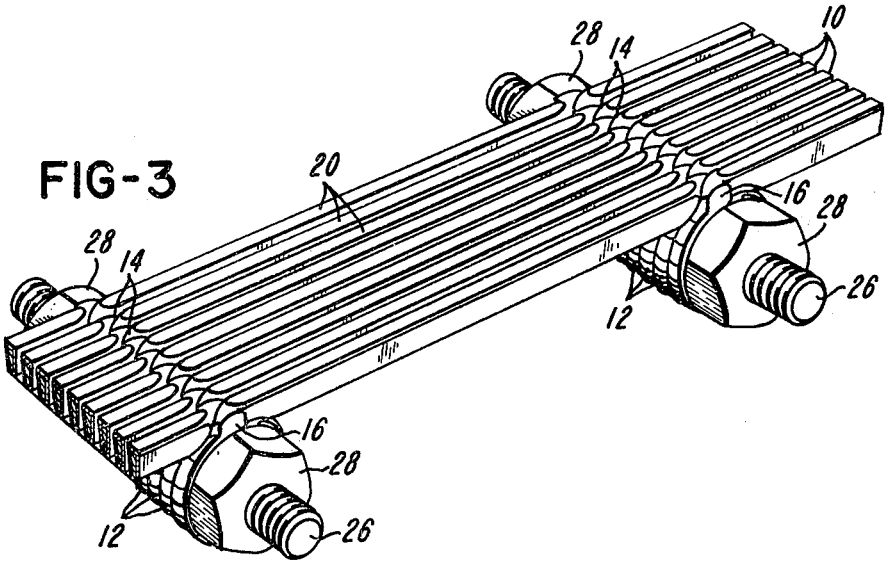
FIG. 3 is a perspective view illustrating the construction of an industrial screen in accordance with the present invention.

FIG. 3 illustrates a section of an assembled screen. The illustration is highly schematic inasmuch as a practical industrial screen panel might be two feet wide and four feet long. A typical center-to-center separation between loops is 2 and ¾ inches. Thus the number of loops in each wire extending the four foot length of the screen may be 18. Likewise, a typical design dimension for the thickness of the crossover after chrome plating is 0.150 inch and approximately 154 of the looped wires are required to build up a two foot wide screen.

The wires 10 are supported in juxtapose relation by transverse support rods 26. For purposes of illustration the support rods are shown as being threaded at their ends for the receipt of hex nuts 28. In a typical screen the support rods are 5/16 inch in diameter and the loops 12 are slightly greater than 5/16 inch inside diameter so that support rods can enter the loops 12 without force.

On first assembly, the screen will not assume its designed dimensions until the wires are compressed along the length of the rods 26 to take up most of the springback. The aggregate looseness including springback along the length of a rod 26 holding 154 loops can be between one and two inches. The hex nuts 28 are torqued to bring the screen within its designated dimensions. While not shown, the threaded ends of the rods 26 no longer required to support the hex nuts 28 are cut away or otherwise removed from the screen. In a commonly used alternate mode of assembly, the wires 10 are assembled on 5/16 inch rods each upset at one end to form a head thereon. After the assembled wires have been compressed to take up springback, the unneeded extra lengths of the 5/16 inch rods are removed, leaving only enough metal to permit the ends of the rods to be upset to form a second head for each rod, thus confining the wires between the heads at the ends of the rods.

Regardless of the mode of assembly care is taken not to so tightly compress the crossovers 14 one against the other that an excessive pressure between the adjacent loops causes the screen to behave as a rigid screen. It will be noted that the only parts of the adjacent wires 10 in the assembled screen which contact one another are the shoulders 16. Many of the benefits of the hard chrome plating described in this application are received when only the confronting surfaces of the shoulders 16 have been hard chrome plated. Thus, it is popular to use type 304 stainless steel for producing the looped screen wires. If one merely deposits the hard chrome plate on the abutting surfaces of the shoulders 16, one produces an industrial screen having all the wear characteristics previously experienced in such screens with the added benefit that frictional wear occurring at the confronting surfaces of the crossovers 14 is very materially reduced. Preliminary experience in the use of stainless steel wires which have been hard chrome plated in accordance with the present invention indicates that the screen life may be approximately doubled through the use of hard chrome plating even if such plating is deposited on only the confronting shoulders 16 of adjacent wires.

As a practical matter, it is pointless to confine the chrome plating to the shoulders 16. It is far more efficient to plate the entire wire, thus giving the working surfaces 25 an enhanced wear resistance. Thus, the Rockwell of type 304 stainless steel is in the range 20 to 35 C. By way of contrast the surface hardness of screen wires chrome plated in accordance with the present invention is in the range 73 to 75 Rockwell C. The result is three to four times the operating life heretofore achieved with the popular stainless steel screens.

In the preceeding remarks the primary emphasis has been given to the advantages of finely crystalline hard chrome plating of conventional stainless steel screen wires. This affords a convenient bases for comparing the performance of screens produced in accordance with the present invention with the type heretofore commonly used in industry. It is to be recognized, however, that stainless steel has been popular, not only for its wear characteristics, but for its chemical resistance. The finely crystalline hard chrome plating of the present invention has at least an equal chemical resistance for most industrial applications and, accordingly, there is no necessity to use stainless steel as a base metal under a finely crystalline hard chrome plating.

Thus the present invention can be practiced at a considerable saving by utilizing ordinary carbon steel as the base metal in lieu of stainless steel.

Aluminum wires are not ordinarily considered for use in industrial screens, even when assembled on steel support rods, because the abrasion resistance of aluminum is poor in relation to that of steel. Further, the ease with which aluminum wires corrode in mining and other industrial environments is well known. However, hard chrome plating as described in this application substantially eliminates both of these problems. Thus the chrome plating at the shoulders 16 of aluminum wires will eliminate the tendancy of aluminum wires to abrade themselves. This factor standing alone is enough to render aluminum wires assembled on steel support rods competitive, for the first time ever, in numerous industrial screen applications. The added factor of high Rockwell hardness at the working surfaces of hard chrome plated aluminum wires vastly extends the range of applications for aluminum screen wires. Perhaps the most important benfit offered by the hard chrome plating of aluminum wires, however, resides in the fact that the chrome plating shields the aluminum from corrosive chemicals. Thus, aluminum wires might have been used heretofore in the washing and dehydrating of coal except that the acid usually found in the water available at coal mines and used in the washing of coal so quickly deteriorates aluminum that its use as a screen material, absent the chrome plating of the present invention, would be impractical.

A further importance to the use of aluminum wire resides in the obvious reduction in the weight of industrial screens that results. As previously indicated, stainless steel screen wires are popular in numerous industrial screening operations. In a large percentage of such operations it is required that the screen be mechanically vibrated. Accordingly modern day vibrators are designed to withstand the rigors of cyclically repeated actions against the mass of the stainless steel screens together with the mass of whatever loads are supported by the stainless steel screens. The use of hard chrome plated aluminum wires in lieu of steel wires even though the support rods may be steel as before, substantially reduces the rigors to which the vibrating machinery is exposed and as a result of the operating life of even the vibrating machinery is materially extended.

An unexpected benefit that has resulted from the development of hard chrome plated screen wires as herein described resides in the ability of the chrome plated surfaces to release or slough off fatty and oily substances tending to cling thereto. In various industrial processes, including the processing of sewage, screen devices are utilized in separating waste materials from liquid streams in which the materials are entrained. A major problem resides in the tendency of fatty and oily substances to cling to and occlude or blind the screens. Preliminary tests with chrome plated wires in accordance with the present invention reveal that the finely crystalline hard chrome surfaces allow the entraining fluid the dislodge fatty or oily substances tending to adhere to the screens. Thus the need for shutdowns during which the screens would be degreased has been substantially eliminated.

Although the preferred embodiments of this invention have been described, it will be understood that various changes may be made within the scope of the appended claims.

Having thus described my invention, I claim:

1. In the method of forming an interflexing screen which may be vibrated in use which comprises the steps of forming loops spaced apart along the length of a plurality of wires, and assembling said wires on support rods passing through said loops, the improvement including the step of lubricating the surfaces of said wires which will contact adjacent wires after the foregoing assembly by electrolytically depositing hard chrome on said screen wires after the same are looped and before the same are assembled into a screen.

2. The method of claim 1 wherein the hard chrome deposited on said screen wires has a thickness of at least 0.003 inch.

3. A method of forming an interflexing screen of the type having plural screen wires arranged side by side, each screen wire having plural loops formed therein, each wire at loop crossover points being coined to form shoulders, the wires being assembled on support rods passing through the loops of adjacent wires with the shoulders of adjacent wires in abutment with one another, the screen wires being vibrated in use, the improvement including electrolytically depositing hard chrome on said wires after the loops are formed and the wires coined and before the same are assembled onto the support rods so that the wires including the shoulders thereof are coated by a hard chrome surface.

4. The method of claim 3 wherein the hard chrome deposited on said screen wires has a thickness of at least 0.003 inch.

* * * * *